US006412144B1

(12) United States Patent
Braid et al.

(10) Patent No.: US 6,412,144 B1
(45) Date of Patent: Jul. 2, 2002

(54) COUNTERBALANCE SPRING MOUNTING ARRANGEMENT FOR A SASH WINDOW

(75) Inventors: Harold Keith Braid, Braceborough; Simon Christopher Braid, Maxey, both of (GB)

(73) Assignee: Omega International Ltd., Peterborough (GB)

( * ) Notice: Subject to any disclaimer, the term of this patent is extended or adjusted under 35 U.S.C. 154(b) by 0 days.

(21) Appl. No.: 09/841,104

(22) Filed: Apr. 24, 2001

Related U.S. Application Data

(63) Continuation-in-part of application No. 09/777,088, filed on Feb. 5, 2001.

(51) Int. Cl.[7] ..... E05F 1/00

(52) U.S. Cl. ..... 16/197; 16/193; 16/DIG. 16; 49/445

(58) Field of Search ..... 16/197, 193, DIG. 16, 16/206, 205, 202, 400, 401; 49/176, 181, 445, 446, 447, 454, 456, 457

(56) References Cited

U.S. PATENT DOCUMENTS 2,644,193 A * 7/1953 Anderberg ..... 16/197
3,992,751 A * 11/1976 Foster et al. ..... 16/197
4,953,258 A * 9/1990 Mennuto ..... 16/193
4,961,247 A * 10/1990 Leitzel et al. ..... 16/193
5,157,808 A * 10/1992 Sterner, Jr. ..... 16/197
5,210,976 A * 5/1993 Cripps ..... 49/181
5,365,638 A 11/1994 Braid et al.
5,661,927 A * 9/1997 Polowinczak ..... 49/446

FOREIGN PATENT DOCUMENTS

GB 2278626 12/1994
GB 2295634 6/1996

* cited by examiner

*Primary Examiner*—Chuck Y. Mah
(74) *Attorney, Agent, or Firm*—Richard M. Goldberg

(57) ABSTRACT

A sash window counterbalance arrangement for counterbalancing the weight of a sash window, includes a sash window jamb with a channel defined within the sash window jamb, the channel having a rear wall and a pair of side walls, a sash window shoe slidable in the channel, a spring arrangement connected at one end to the sash window shoe, and a spring support mounting fitted within the channel to support the spring arrangement, the spring support mounting including a locating peg projecting from the spring support mounting to engage a locating aperture defined within one of the channel walls and locate the spring support mounting along the channel, and a self tapping screw fastener engaging the spring support mounting and one of the channel walls to secure the spring support mounting to and within the channel.

8 Claims, 4 Drawing Sheets

COUNTERBALANCE SPRING MOUNTING ARRANGEMENT FOR A SASH WINDOW

REFERENCE TO RELATED APPLICATION

The present application is a continuation-in-part of U.S. patent application Ser. No. 09/777,088, filed Feb. 5, 2001 to the same inventors and entitled A SPRING MOUNTING ARRANGEMENT FOR A SASH WINDOW COUNTERBALANCE ARRANGEMENT.

BACKGROUND OF THE INVENTION

The present invention relates to sash windows and in particular to a mounting for a spring counterbalance arrangement used in such sash windows.

Modern sash windows utilise flat coiled ribbon springs which are mounted within the window jamb channels of the window frame and are arranged to unwind as the sash window is slid and moved within the window frame. The coiled springs provide a counterbalancing force, by virtue of the spring tension of the springs, to counterbalance the weight of the sash window thereby making movement and opening of the window easier. Typically the coiled springs are mounted to the window frame and within the vertical window jamb channels either side of the sash window using a mounting/support arrangement. A free end, referred to as a tail, of the spring is connected to a sash shoe slidably located within the window jamb channel section of the window frame. The sash shoe in turn is connected to the sash window, usually towards the lower portion of the sash window. The coiled. springs are generally of a constant tension type in which an outer profile of the coil is rotatably held and supported within the spring mounting/support. The spring mounting/support is secured to the window frame and within the window jamb channel. An inner end of the spring is free such that the coiled spring can rotate as the spring is unwound and the tail (outer free end) of the spring attached to the sash shoe, is extended and drawn out as the window is moved.

Examples of prior arrangements of the above general type are well-known and common place within the industry. Specific examples are described in U.S. Pat. No. 5,365,638, and also UK patents GB 2,278,626 and GB 2,295634. A yet further example is described in our copending application GB 0027397,9 filed on Nov. 9, 2000, the text of which is incorporated in its entirety herein by reference.

In such prior systems the springs and their mounting/support assemblies are located within the window frame jamb channels. During assembly the spring mountings are inserted into the channel sections and slid within the channel to the required position along the length of the channel. The mounting/support is then secured to the window frame channel and in position along the channel by means of a fixing screw-or screws which pass through an aperture in the mounting and engage the window jamb. In this way the spring mounting, and so springs supported and held within the mounting, are secured within and to the window channel.

While this mounting arrangement, and similar prior arrangements, provide a practical method of mounting and supporting the counterbalance spring, there are a number of problems with such an arrangement and the mounting arrangement of the springs can be improved generally.

In particular in a production environment the spring support and mounting arrangement has to be accurately slid into position along and within the window jamb channel section. The accurate positioning of the counterbalance spring is important to ensure the correct operation of the counterbalance arrangement. Once in position the fixing screws then have to be fitted to secure the counterbalance spring arrangement in position and to the window jamb. specifically the fixing holes within the spring support mounting also have to be aligned with pilot holes or indentations within the window jamb. Since access within the window jamb is limited and restricted the accurate positioning can be an intricate, difficult, and time-consuming operation.

SUMMARY OF THE INVENTION

It is therefore desirable to provide an improved sash window counterbalance spring support arrangement which addresses this problem and which provides an arrangement which is simpler and easier to accurately install within the window jamb, and/or which offers improvements generally.

According to the present invention there is provided a sash window counterbalance spring mounting arrangement as described in the accompanying claims.

In an embodiment of the invention there is provided a sash window counterbalance arrangement for counterbalancing the weight of a sash window. The arrangement comprises a sash window jamb with a channel defined within said sash window jamb having a rear wall and a pair of side walls. A sash window shoe is slidably located in the said channel. A spring arrangement is connected at one end to said sash shoe, and a spring support mounting is fitted within said channel to support said spring arrangement. The spring support mounting comprises a locating peg projecting from said spring support to engage a locating aperture defined within one of said channel walls and locate the spring support mounting along said channel, and a fastener engaging said spring mounting support and one of said channel walls to secure said spring support mounting to and within said channel.

By such an arrangement the spring support can be accurately and easily located at the correct position along the channel with the locating peg engaging the locating aperture when the spring support is slid along the channel into the correct position. The spring support is then secured in position by the fastener that engages both the spring support mounting and channel.

The fastener preferably comprises a self-tapping fixing screw.

BRIEF DESCRIPTION OF THE DRAWINGS

The present inventions will now be described by way of example only with reference to the following figures in which.

DETAILED DESCRIPTION

Figure 1:
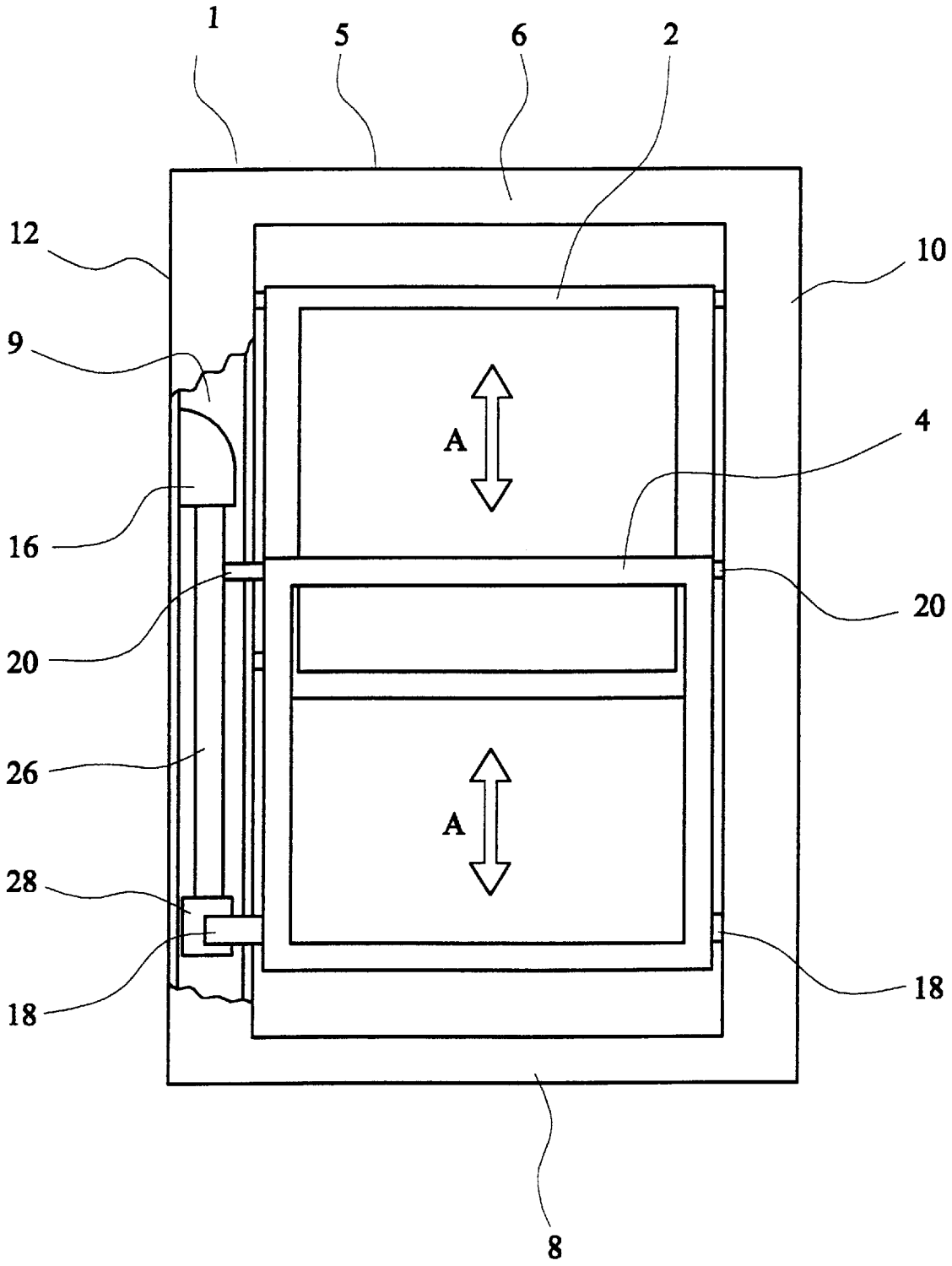
FIG. 1 is a schematic representation of a complete sash window assembly, with part of the window from the jamb channel cut away to show the counterbalance spring arrangement.

Referring to FIG. 1, a sash window 1 comprises upper 2 and lower 4 sashes, which are slidably mounted within a window frame 5 such that each sash 2,4, can be slid vertically, as indicated by arrow A, to open the window. The sashes 2,4, are disposed generally vertically in an overlapping arrangement with one disposed closely adjacent to the other and in operation sliding behind each other.

The window frame 5 comprises upper 6 and lower 8 horizontal frame members and two vertical laterally spaced window jamb members 10,12. The window jamb members 10,12, each define double vertically extending window jamb channel sections. The window jamb channel sections 9, of the double channel section in each window jamb 10,12, are disposed side by side adjacent to and along the length of the window jamb 10,12, adjacent to the lateral side of a respective sash window 2,4. Each channel section is defined by a rear wall 11, pair of side walls 13 projecting forward from the rear wall 11 and a pair of front walls 14*a*,14*b*, which are parallel and spaced from the rear wall 11 and partially close off the channel section 9. An open part 15 of the channel section 9 faces the respective lateral side of the sash window 2,4. The window frame 5, and window jamb channels 9 are typically fabricated from extruded uPVC sections which are joined together to form the window frame S. Each of the channel sections 9 of the double channel sections is generally similar with each channel section 9 of the double channel section within each of the window jambs 10,12, associated with a respective sash window 2,4.

Pivot pins 18, located towards the lower part of the sash window 2,4, extend and project laterally from the lower sides of the sash window 2,4. Tilt latches 20, located towards the upper part of the sash window 2,4, similarly project laterally from the sides of the sash window 2,4. The distal ends of the tilt latches 20 and pivot pins 18 are engaged within the open part 15 of the respective window jamb channels 9. The sash windows 2,4, are thereby slidably located within and with respect to the window frame 5 by the engagement of the pivot pins 18 and tilt latches 20 within the window jamb channels 9. The tilt latches 20 are also laterally retractable with respect to the sash window 2,4, such that the distal ends of the tilt latches 20 can be withdrawn from the window jamb channel sections 9. This allows the upper part of the sash windows 2,4 to be disengaged allowing the sash window 2,4 to be tilted and pivoted about the pivot pins 18.

Spring counterbalance mechanisms 16, to counterbalance the weight of the sash windows 2,4 and make vertical sliding of the sash windows 2,4, easier, are mounted and located within the channel sections 9 of the window jambs 10, 12. For each sash window 2,4 a pair of spring counterbalance mechanisms 16 are provided, one on each lateral side of the sash window 2,4, with the mechanisms 16 located and mounted within the respective channel section 9 in the window jamb 10,12 for each sash window 2,4. In FIG. 1 only one such mechanism 16 has been schematically shown for one side of sash window 4, in the interests of clarity and brevity. The other spring counterbalance mechanism 16 on the other lateral side and mounted within the opposite window jamb channel section of the opposite window jamb 10 is generally similar. The other sash window 2 has a similar arrangement albeit mounted within the other channel section 9 of the respective window jambs 10,12 and located at a different position along the window jamb 10,12 as required for operative movement of that sash window 2.

The spring counterbalance mechanism 16 comprises a spring arrangement comprising one or more springs (not shown), which are located and supported by and within a spring support mounting 24. The spring support mounting 24 is located within the channel section 9 within the window jamb 12 and window jamb channel section 9 and is fixed and secured in position to the window jamb 12. The outer free ends of the springs are connected together to form a common tail 26 which extends, and in operation is drawn out from the spring support mounting 24, and is connected to a sash shoe 28. The sash shoe 28 is slidably located within the window jamb channel section 9. The pivot pin 18 of the sash window 4 is located and engaged within the sash shoe 28.

In operation, as the sash window 4 slides vertically within the window frame 5 the sash shoe 28 which is connected thereto slides vertically within the window jamb channel 9 and draws out the spring tail 26 from the spring support 24. This unwinds the spring (or springs) providing a vertical tension force. This counterbalances and offsets the weight of the sash window 4.

As described above the arrangement is generally conventional.

Figure 3:
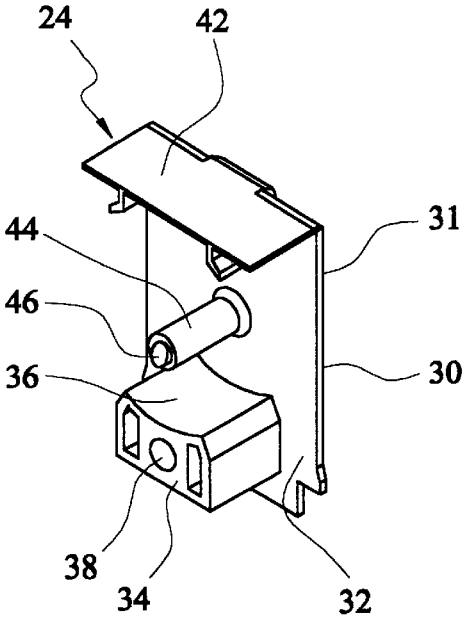
FIG. 3 is a more detailed perspective view of the counterbalance spring support, in isolation, for a single spring in accordance with a first embodiment of the invention.
Figure 4:
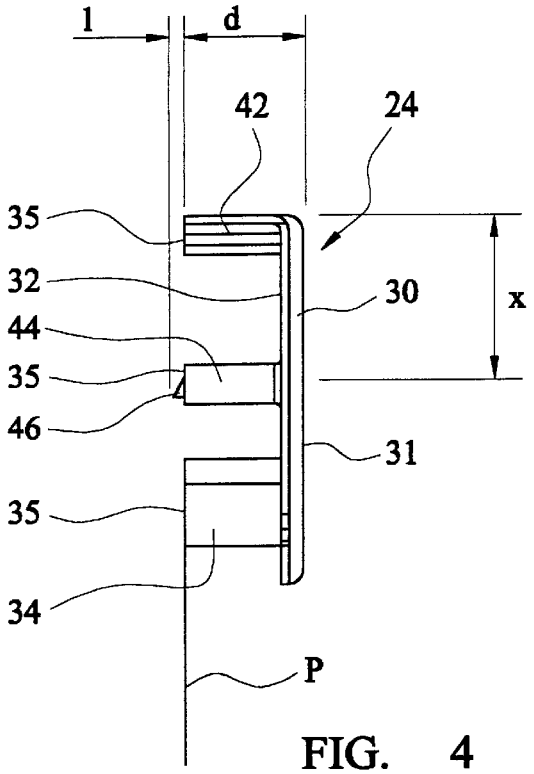
FIG. 4 is a side view of the counterbalance spring support mounting shown in FIG. 3.

The spring support mounting 24 of a first embodiment of the invention is shown in isolation and in more detail in FIGS. 3 and 4. The spring support mounting 24 comprises a generally planar main body portion 30 having a front 31 and rear surface 32. A spring support projection 34 projects from the rear surface 32 towards the lower end of the main body 30. The upper surface of the spring support projection is curved defining a concave spring support surface 36. When assembled a flat ribbon coil spring (not shown) is fitted into the spring support mounting 34 with the outer curved profile of the coiled spring resting on and abutting against the curved spring support surface 36. The spring is supported on and by the support surface of the spring support projection 34. In this embodiment the spring support mounting 24 supports only a single spring.

A bore 38 is defined within the spring support projection 34 to receive a fixing screw (not shown) to secure the spring support mounting 24 to the window jamb 12. A top cover 42 also projects from the rear surface 32 of the main body 30 at the top of the main body 30. When the spring support mounting 24 is installed within the window channel section 9 this top closes off the top of the channel to close off the spring mounting and protect the spring mounted therein. As shown the top cover 42 may also have a profiled, or further support features, adjacent to the outer profile of the upper part of the coiled spring to abut against and support the outer profile of the coiled spring.

Figure 2:
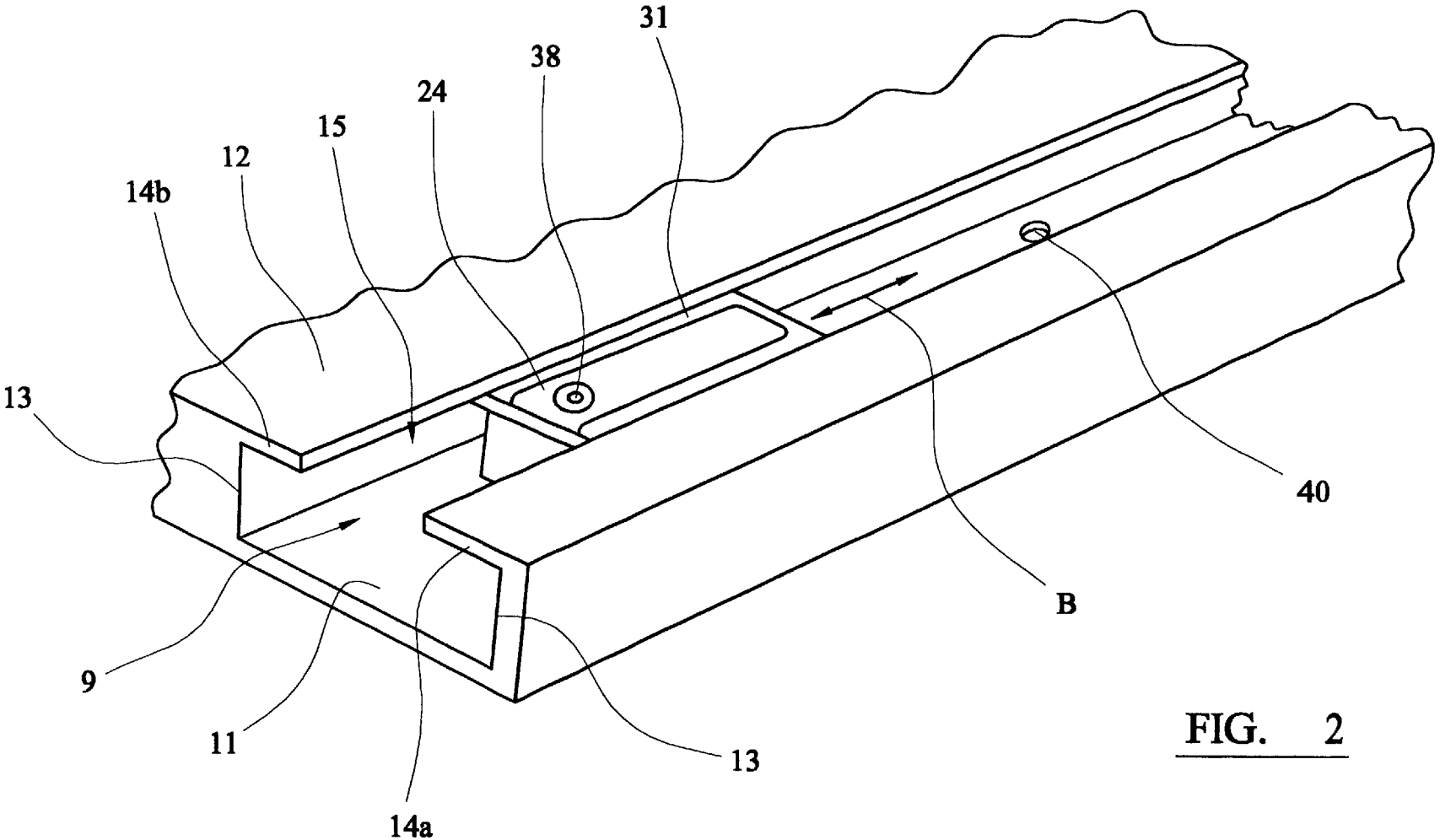
FIG. 2 is a schematic perspective illustrative view of the part of the window frame jamb showing the fitting of the counterbalance spring support mounting within the channel.

At a position generally within the centre of the installed coiled spring, there is a further, generally cylindrical projection 44 from the rear surface 32 of the spring support 24. The distal end of this projection, the spring support projection 34, and top projection 42 are spaced from the same distance d from the main body 30 of the spring support mounting 24 and define a rear abutment surface 35 of the spring support mounting 24, along a plane P parallel to the front and rear surface 31, 32 of the spring support mounting 24. The spring support mounting 24 is dimensioned to fit within the channel section 9 of the window jamb 10,12, as generally shown in FIG. 2, such that this rear abutment surface 35 abuts against the rear wall 11 of the window jamb 12 channel section 9. The front surface 31 of the main body 30 faces outwards through the channel opening 15 with the spring located and supported within the spring support mounting 24 thereby enclosed by the spring support mounting 24 and channel walls 11,13,14*a*,14*b*.

A small cylindrical locating peg 46 projects from the distal end of the cylindrical projection 44. This locating peg projects a slight distance l beyond the plane P of the rear abutment surface 35, and beyond the other projections, from the rear surface 32 of the main body 30.

To install and assemble the counterbalance arrangement the spring support mounting 24, with the coiled spring installed within the support mounting 24, is inserted into the respective window jamb channel section 9 through the end of the channel section 9, or through an enlarged opening of the channel section 9. The spring support mounting 24 is slid along the channel section 9 to the required mounting position. Predrilled in the rear wall of the window jamb channel 9 there is a locating hole or recess 40 at the required mounting position of the spring support mounting 24. This locating hole 40 is predrilled into the channel section 9 during the initial manufacture and cutting of the window jamb 10, 12 and window frame 5. Consequently the locating hole 40 can be accurately and easily predrilled using automated machinery at this time. As the spring support mounting 24 is slid within the channel 9 to the required position it is pressed rearwards towards and against the rear wall 11 of the channel 9. As the spring support mounting 24 is slid along the channel 9 to the required mounting position the projecting locating peg 46 encounters and engages within the locating hole 40 with the rear abutment surface 35 of the other projections then abutting against the rear wall 11 of the window jamb channel 9. The engagement of the locating peg 46 within the locating hole 40 in the rear channel wall 11 locates the spring support mounting 24 at the correct position along the channel section 9. A self tapping fixing screw (not shown) can then be fitted through the fixing screw aperture 38 in the spring support mounting 24 and screwed into the rear wall 11 of the window jamb 10, 12 to secure the spring support mounting 24 to the window jamb 10, 12.

The locating peg 46 and its engagement within a predrilled locating hole 40 within the window jamb rear wall 11 provides a simple yet effective means to locate the spring in the correct position during assembly. This makes assembly considerably quicker and easier with the spring support mounting 24 becoming to some extent self-locating, whilst final fixing and securing of the spring support mounting 24 is then provided by the fixing screw. With this arrangement there is no need for the person installing and assembling the spring support arrangement to accurately place the spring support mounting 24 in the correct position since this is determined by the engagement of the locating peg 46 in the predrilled locating hole 40. It will be appreciated that the predrilling of the locating hole 40 using automated machinery during the initial cutting and fabrication of the window jamb 12 ensures the accurate location of the hole 40 and so of the spring support mounting 24. It is also considerably easier to predrill the locating hole 40 in the window jamb 12 rather than to have to accurately locate and secure the spring support mounting 24 in position during assembly as with prior arrangement.

Since the locating peg 46 and fixing screw are spaced apart along the length of the spring support mounting 24 rotation of the spring support mounting 24 about either the locating peg 46 or fixing screw is prevented whilst only requiring the use of a single screw.

Figure 5:
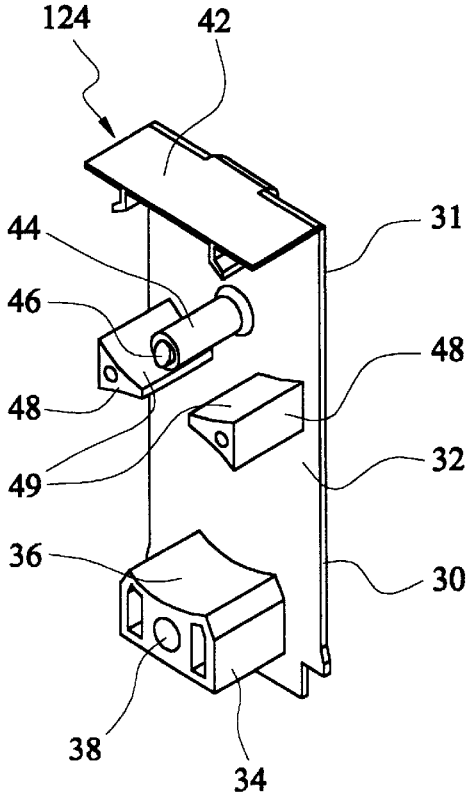
FIG. 5 is a perspective view, similar to FIG. 3, but of a counterbalance spring support mounting in accordance with a second embodiment of the present invention for supporting a double counterbalance spring arrangement.
Figure 6:
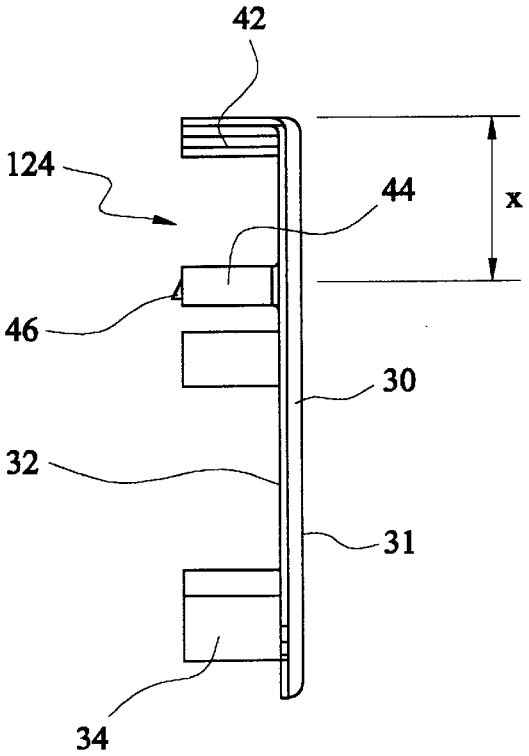
FIG. 6 is a side view of the counterbalance spring support mounting shown in FIG. 5.

FIGS. 5 and 6 show a second embodiment of the invention and spring support mounting 124 for two coiled springs (not shown). The spring support mounting 124 of this embodiment is generally similar to that of FIGS. 3 and 4 and like references have been used for like features and only the differences will be described. In particular the spring support mounting 124 is longer than that of FIGS. 3 and 4 to accommodate two coiled springs. A first coil spring is installed towards the lower end of the spring support mounting 124 with the lower part of the outer profile of the coil spring abutting and resting against the concave surface support surface 36 of the spring support projection 34. The second spring is fitted above the first spring. A pair of further spring support projections 48 project from the rear surface 32 of the spring support mounting 124. These spring support projections 48 have a generally triangular cross section and such that the upper surfaces of the projections define a pair of spring support surfaces 49 forming a cradle against which the lower outer profile of the second spring abuts and is supported. The cylindrical projection 44, from the distal end of which the locating peg 46 projects, is disposed generally in the centre of position of the upper of the two springs. Specifically this cylindrical projection 44 is disposed at the same distance X from the top of the spring support mounting 124 as the cylindrical projection 44 of the first embodiment shown in FIGS. 3 and 4. This advantageously allows this double spring support mounting 124 to be fitted into a window jamb 12 with a locating hole 40 predrilled in the same position as required for the single spring mounting 24 shown in FIGS. 3 and 4, whilst maintaining the top of the spring support mounting 124 at the same position along the window jamb 12. It should be noted that the location of the top of the spring support mounting 124 is particularly important for the correct operation and full sliding opening of the sash window 4. By this arrangement and positioning of the locating peg 46 along the spring support mounting 124 the predrilling of the locating hole 40 in and along the window jamb 12 can be same for both a single spring support mounting 24 and a double spring support mounting 124. This reduces manufacturing costs since the settings for accurately predrilling the locating holes 40 do not have to be adjusted for the different spring supports 24,124.

A third embodiment of the present invention, and spring support mounting 224, is shown in FIGS. 7 and 8 and again like reference numerals will be used for like items. In this embodiment the locating peg 46 projects from the top projection 42 of the spring support mounting 224 and there is no separate cylindrical projection for the locating peg 46.

Figure 7:
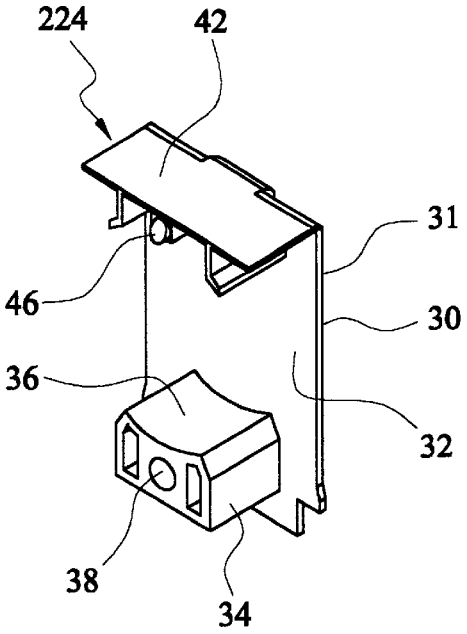
FIG. 7 is a perspective view of a counterbalance spring support mounting in accordance with a third embodiment of the present invention.
Figure 8:
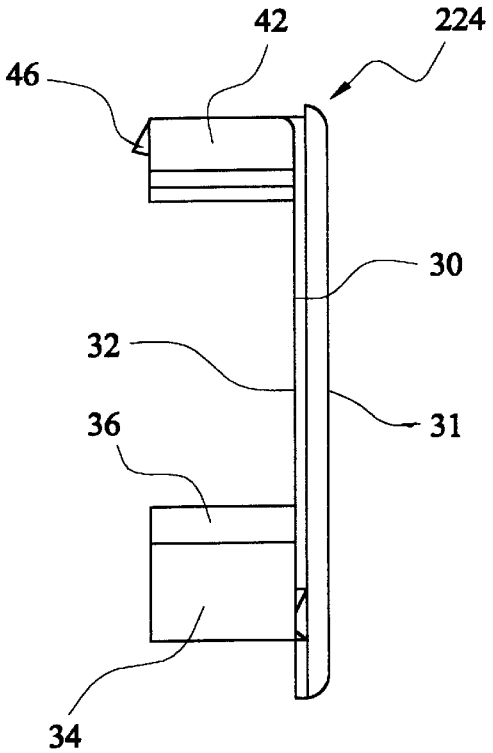
FIG. 8 is a side view of the counterbalance spring support mounting shown in FIG. 7.

By providing the locating peg 46 at the top of the spring support mounting 224 a locating hole 40 for a single spring support mounting, as shown in FIGS. 7 and 8, can also be used with a similar spring support mounting (not shown) for two springs, whilst ensuring that the top of the respective spring support mountings are at the same required position along the window jamb 12 channel section 9.

For assembly purposes the spring support mounting 224 is usually slid in top first, but may be inserted in either direction (see double-headed arrow B in FIG. 2). The projecting locating peg 46 at the top may be chamfered in one (the upward) direction, as shown, or may be chamfered in two directions (both upwards and downwards) to define a symmetrical point.

Figure 9:
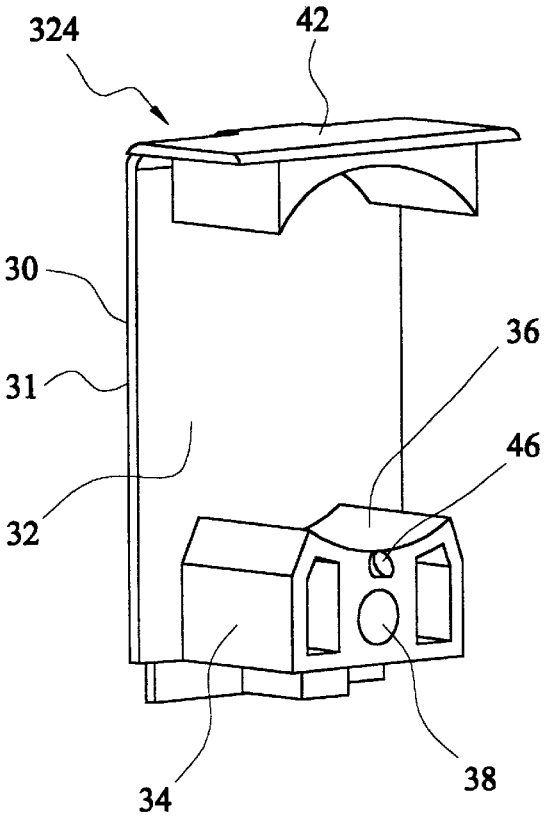
FIG. 9 is a perspective view of a counterbalance spring support mounting in accordance with a third embodiment of the present invention.
Figure 10:
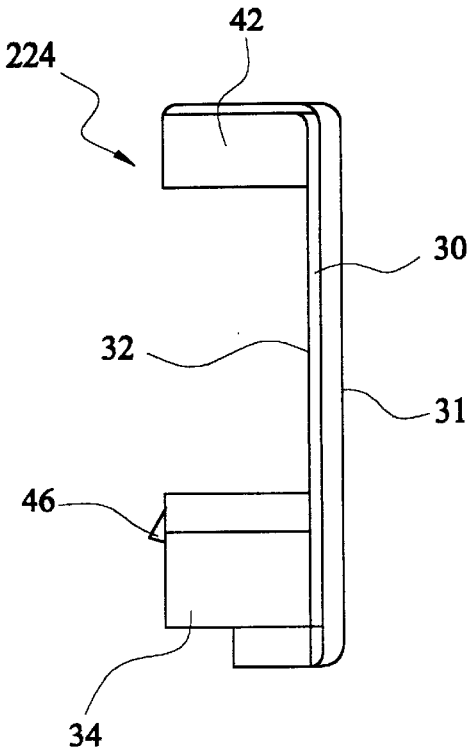
FIG. 10 is a side view of the counterbalance spring support mounting shown in FIG. 9.

A yet further embodiment and spring support mounting 324 is shown in FIGS. 9 and 10. In this case the locating peg 46 projects from the lower spring support projection 34 of the spring support mounting 324. The locating peg 46 is positioned vertically above and in line with the aperture 38 for the fixing screw.

In all of the embodiments described above the spring support mounting is preferably fabricated from a moulded plastic material.

It will be appreciated by those skilled in the art that whilst single and double spring support mountings have been described the same principles can be applied to produce similar spring support mountings for any number of springs as may be required. The use of a locating peg in combination with a fixing screw can also be used on modular spring support mountings. Such modular spring support mountings being described for example in U.S. Pat. No. 5,365,638. It will also be appreciated that whilst a self tapping fixing screw is the preferred means for securing the spring support once located by the locating peg in the correct position, other fastening means, for example a rivet could be used. Furthermore more than one screw, or other fastening means, could be used, although from a cost and ease of assembly perspective a single screw is preferred. The predrilled locating hole within which the locating peg is engaged can also comprise a simple blind recess defined within the channel walls. Many other minor variations and modifications of the above described invention will also be apparent to those-skilled in the art without departing from the invention.

What is claimed is:

1. A sash window counterbalance arrangement for counterbalancing the weight of a sash window, comprising:

a sash window jamb with a channel defined within said sash window jamb, said channel having a rear wall and a pair of side walls, a sash window shoe slidable in said channel, a spring arrangement connected at one end to said sash window shoe, and a spring support mounting fitted within said channel to support said spring arrangement, the spring support mounting comprising a locating peg projecting from said spring support mounting to engage a locating aperture defined within one of said channel walls and locate the spring support mounting along said channel, and a fastener engaging said spring support mounting and one of said channel walls to secure said spring support mounting to and within said channel.

2. A sash window counterbalance arrangement as claimed in claim 1 in which the fastener comprises a screw.

3. A sash window counterbalance arrangement as claimed in claim 2 in which the fastener comprises a self-tapping screw.

4. A sash window counterbalance arrangement as claimed in claim 1 in which the locating peg is located towards a top of the spring support mounting.

5. A sash window counterbalance arrangement as claimed in claim 1 in which the spring arrangement comprises at least one flat coiled ribbon spring.

6. A sash window counterbalance arrangement as claimed in claim 5 in which said locating peg projects from the spring support mounting generally within a center of one of said at least one flat coiled ribbon spring.

7. A sash window counterbalance arrangement as claimed in claim 1 in which a bore for receiving said fastener is defined within said spring support mounting.

8. A sash window counterbalance arrangement as claimed in claim 7 in which said locating peg projects from said spring support mounting adjacent to said bore for said fastener.

* * * * *